US010883354B2

(12) United States Patent
Watson

(10) Patent No.: US 10,883,354 B2
(45) Date of Patent: Jan. 5, 2021

(54) ROD PUMP GAS ANCHOR AND SEPARATOR FOR HORIZONTAL WELLS AND METHOD OF USE

(71) Applicant: Texas Tech University System, Lubbock, TX (US)

(72) Inventor: Marshall Watson, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 135 days.

(21) Appl. No.: 16/135,585

(22) Filed: Sep. 19, 2018

(65) Prior Publication Data

US 2019/0085679 A1 Mar. 21, 2019

Related U.S. Application Data

(60) Provisional application No. 62/560,279, filed on Sep. 19, 2017.

(51) Int. Cl.

| | |
|---|---|
| ***E21B 43/38*** | (2006.01) |
| ***E21B 17/18*** | (2006.01) |
| *E21B 43/12* | (2006.01) |

(52) U.S. Cl.

CPC ..... *E21B 43/38* (2013.01); *E21B 17/18* (2013.01); *E21B 43/127* (2013.01)

(58) Field of Classification Search

CPC ..... E21B 43/38; E21B 43/127; E21B 17/18; E21B 2043/125

See application file for complete search history.

(56) References Cited

U.S. PATENT DOCUMENTS

| | | | | |
|---|---|---|---|---|
| 3,624,822 | A | 11/1971 | Carle | |
| 4,088,459 | A | 5/1978 | Tuzson | |
| 4,481,020 | A | 11/1984 | Lee | |
| 5,154,588 | A | 10/1992 | Freet | |
| 5,653,286 | A | 8/1997 | McCoy et al. | |
| 6,179,054 | B1 | 1/2001 | Stewart | |
| 7,270,178 | B2 * | 9/2007 | Selph | E21B 43/128 166/105.5 |
| 8,528,648 | B2 | 9/2013 | Zupanick | |
| 8,657,014 | B2 * | 2/2014 | Rogers | E21B 43/00 166/372 |
| 9,022,106 | B1 | 5/2015 | McCoy | |
| 2004/0060705 | A1 | 4/2004 | Kelley | |
| 2017/0016311 | A1 | 1/2017 | Fernandez Restrepo et al. | |
| 2017/0138166 | A1 * | 5/2017 | Wang | E21B 43/128 |

* cited by examiner

*Primary Examiner* — Giovanna Wright
*Assistant Examiner* — Yanick A Akaragwe
(74) *Attorney, Agent, or Firm* — Loza & Loza LLP; Kevin L. Soules

(57) ABSTRACT

A system, method, and apparatus for separating liquid from gas in a horizontal well comprises a first tubing member comprising one of a screen-walled tube and a perforated tube, and a second tubing member configured inside the first tubing member, the second tubing member comprising a blank-walled tube section and one of a screen walled tube section and a perforated tube section, wherein the second tubing member has a smaller diameter than the first tubing member.

17 Claims, 8 Drawing Sheets

ROD PUMP GAS ANCHOR AND SEPARATOR FOR HORIZONTAL WELLS AND METHOD OF USE

CROSS REFERENCE TO RELATED PATENT APPLICATIONS

This patent application claims the priority and benefit under 35 U.S.C. § 119(e) of U.S. Provisional Patent Application Ser. No. 62/560,279 filed Sep. 19, 2017, entitled "ROD PUMP GAS ANCHOR AND SEPARATOR FOR HORIZONTAL WELLS." U.S. Provisional Patent Application Ser. No. 62/560,279 is herein incorporated by reference in its entirety.

TECHNICAL FIELD

The present embodiments are generally related to oil and gas extraction. The embodiments are further related to methods and systems associated with horizontal wells. The embodiments are further related to methods and systems for extracting resources from horizontal wells. More specifically, the embodiments are related to methods and systems for rod pump gas anchors and separators for horizontal wells.

BACKGROUND

Liquid oil and gas production requires the use of pumps to move the liquids from subsurface formations to the earth's surface. There are many designs for such pumps. Across pump designs, a common problem is the presence of gas simultaneously produced with liquid. The gas mixed with the liquid decreases pump efficiency. A number of prior art approaches exist for separating the gas from the liquid. Several of such approaches are illustrated in U.S. Pat. Nos. 3,624,822 and 4,481,020, which describe centrifugal separators for submersible pumps.

In an effort to expand oil and gas production, many wells are now "horizontal wells." Horizontal wells can be characterized as wells where the borehole curves or bends from a substantially vertical direction to a substantially horizontal direction. These wells offer improved rates of oil production and, in some case, other benefits.

Horizontal wells rarely include an acute 90-degree transition from substantially vertical to substantially horizontal. Instead, horizontal wells generally are drilled vertically for a certain distance, and then gently curve to a horizontal direction. The bend in the borehole is often referred to as the build angle portion of the borehole.

Extracting liquids from the horizontal portion of a horizontal well presents a unique set of challenges. For example, it is difficult to convert the substantially vertical motion associated with a rob pump, into the horizontal direction of the borehole, in order to operate a pump located in the horizontal section of the borehole. In addition, liquid pumping is generally more complicated when a significant amount of gas is produced along with the liquid.

Another significant problem associated with horizontal well pumping is that the gas and liquid are not evenly distributed. This results in gas bubbles or pockets, commonly referred to as "slugs," that significantly decrease the efficiency of the pump and can cause significant wear and tear on the pumping equipment. In some cases, this may even result in gas lock of the pumping mechanism.

Prior art solutions to this problem involve the use of separation packers that are intended to separate gas from liquid before it reaches the pump. Separation packers come in a number of different embodiments, but in general, function poorly for horizontal wells. For example, even if the packer is designed to be movable or retrievable, there is always the risk that the packer will become stuck and require very expensive retrieval operations. In addition, the depth of the pumping equipment in the well is difficult to modify without removing the packer.

Accordingly, there is a need in the art for systems and methods that improve the separation of gas and liquid during pumping operations in a horizontal well, as disclosed in the methods and systems described herein.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide improved oil and gas pumping methods and systems.

It is another aspect of the disclosed embodiments to provide methods and systems for horizontal well pumping.

It is another aspect of the disclosed embodiments to provide an improved method and system for separating gas from liquid in horizontal well pumping applications.

It is another aspect of the disclosed embodiments to provide methods and systems for rod pump anchors and separators for horizontal wells.

For example, in the embodiments disclosed herein a method for extracting liquid from a well comprises collecting flowing liquid in a first tubing member comprising one of a screen-walled tube and a perforated tube, moving liquid in the first tubing member into a second tubing member configured inside the first tubing member, the second tubing member comprising a blank-walled tube section and one of a screen walled tube section and a perforated tube section, wherein the second tubing member has a smaller diameter than the first tubing member, pulling liquid in the second tubing member into a mainline pipe connected to the second tubing member with a connection member, and pumping the liquid in the mainline pipe to a well surface.

In another embodiment, a system for separating liquid from gas in a horizontal well comprises a first tubing member comprising one of a screen-walled tube and a perforated tube, and a second tubing member configured inside the first tubing member, the second tubing member comprising a blank-walled tube section and one of a screen walled tube section and a perforated tube section, wherein the second tubing member has a smaller diameter than the first tubing member.

In an embodiment, the second tubing member is in fluidic connection with a mainline pipe. In an embodiment the fluidic connection between the second tubing member and the mainline pipe is located in a non-vertical portion of the horizontal well.

In an embodiment, the blank walled tubing member extends from the connection between the second tubing member and the main pipe, to a point where the second tubing member contacts the first tubing member, and wherein the screen walled section of the second tubing member extends from the point where the second tubing member contacts the first tubing member to a terminal end of the second tubing member. In an embodiment the point where the second tubing member contacts the first tubing member further comprises a point substantially on a lower half diameter of the first tubing member.

In an embodiment the system further comprises a pump attached to the main pipe configured to pump the liquid to a surface of the horizontal well. In an embodiment, the pump comprises a rod pump.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
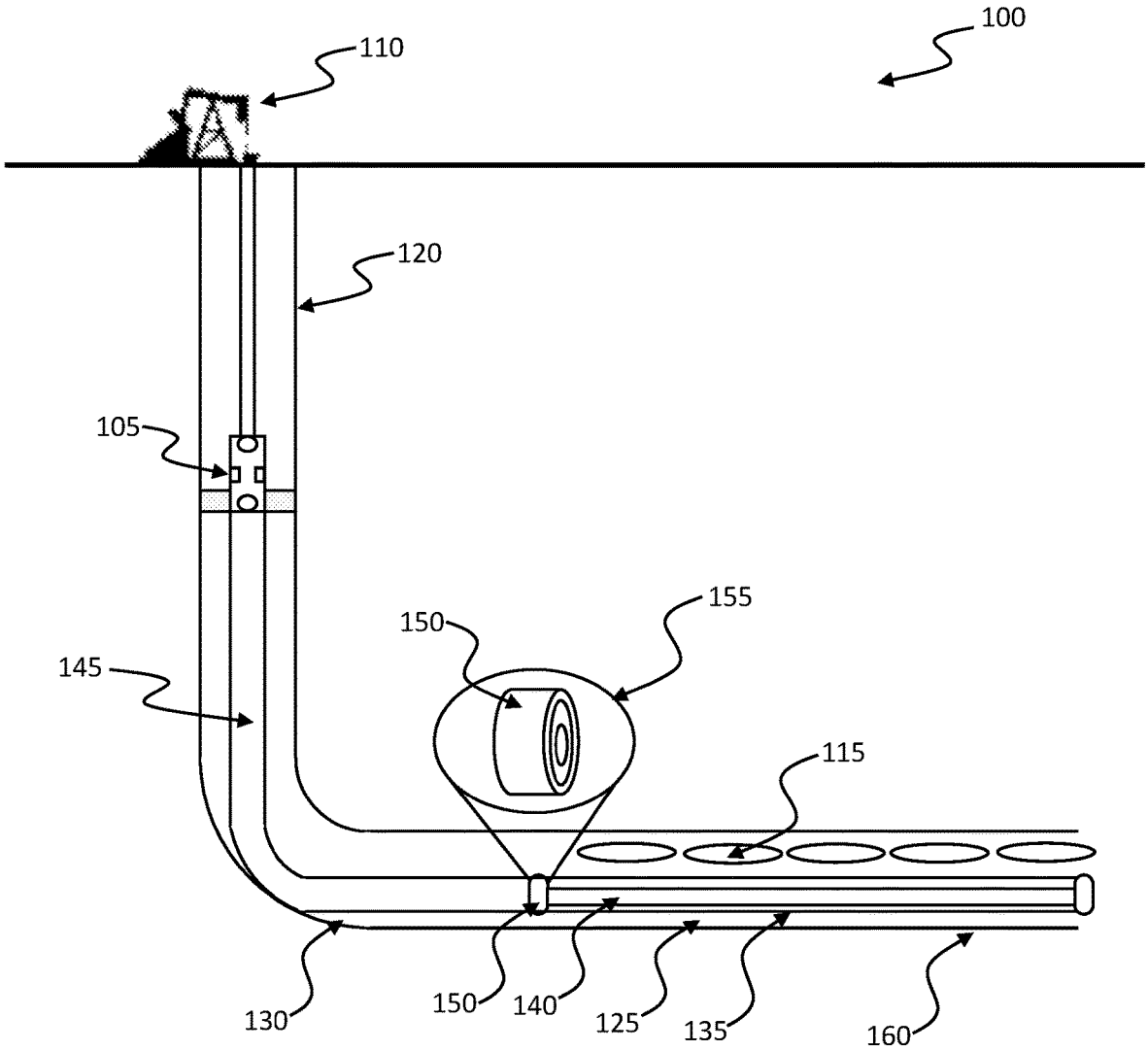
FIG. 1 depicts an extraction system in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter, with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

The embodiments disclosed herein provide a system and apparatus designed to increase the efficiency of liquid pumping in horizontal wells. Such a system 100 is illustrated in FIG. 1. The system 100 includes an oil rod pump 105 and associated rod pump equipment 110. The rod pump 105 drives suction of down hole liquids 115 in an oil well 120. The embodiments herein provide a concentric tube arrangement 125 in the horizontal portion 160 of the well 120 that may reduce gas interference, reduce oil well completion costs that require more expensive separator equipment, and can reduce operating costs by eliminating the expense of removing packer and/or other equipment that fails during use in a well.

The concentric tube arrangement 125 comprises an outer tube 135 and an inner tube 140 (also known as a "dip tube"). The concentric tube arrangement 125 is connected to the mainline 145 (i.e. tubing) via a specially designed fitting 150, that engages with the outer tube 135 but only allows liquid to enter the mainline 145 through the inner tube 140. The fitting 150 is illustrated in an exploded view 155. It should be appreciated that the dimensional characteristics of the various elements provided in FIG. 1 can vary and various tubing dimensions may alternatively be used in other embodiments.

Figure 2:
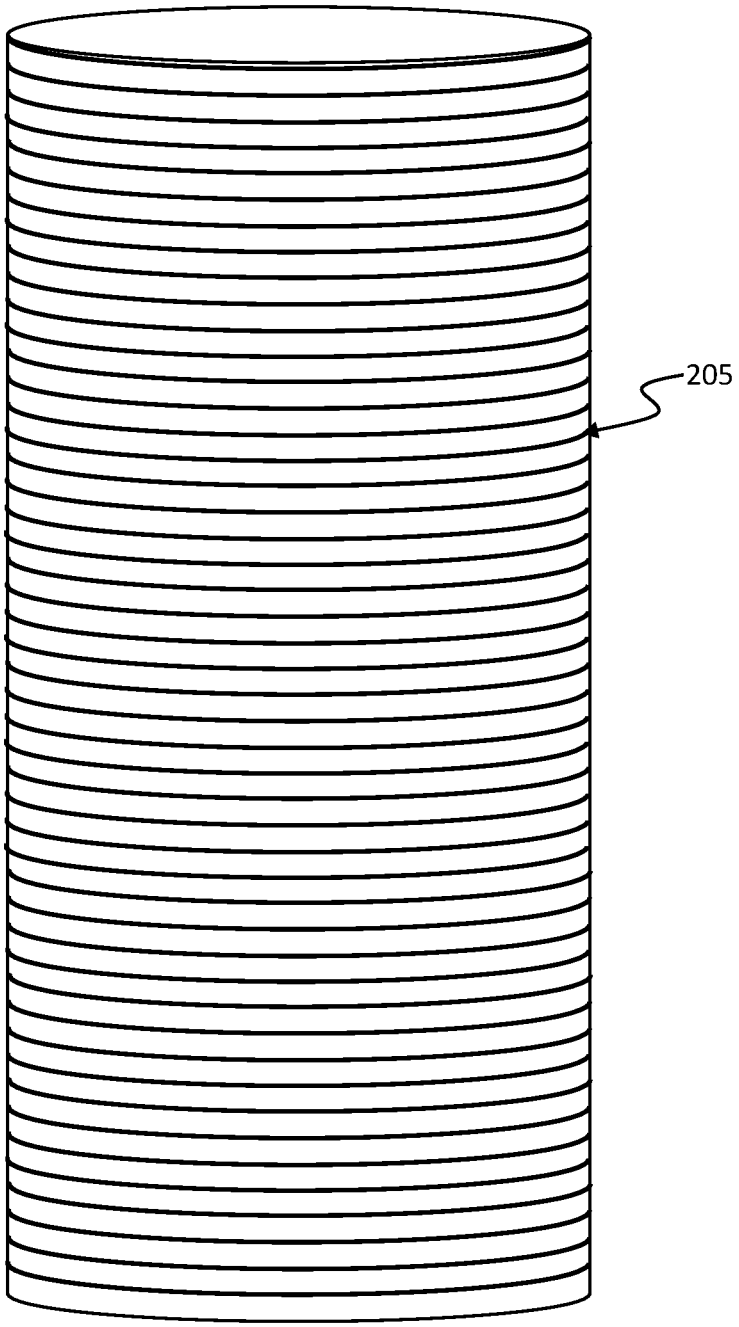
FIG. 2 depicts a screened section of pipe in accordance with the disclosed embodiments.

The disclosed technology is applicable in the horizontal portion 160 of a well 120. At the well bend 130, the concentric tube arrangement 125 can be installed. The outer tube 135 can generally be configured as a screen, a series of screened sections, or a standard tube with one or more screened sections. FIG. 2 illustrates a screen 205, in accordance with the disclosed embodiments.

The concentric tube arrangement 125 is preferably placed in a flat or substantially flat (i.e. horizontal) portion of the horizontal well. It should be understood that, as used in this application the "horizontal" portion of the horizontal well can comprise the build angle portion of the well and any flat or horizontal portion of the well thereafter. Accordingly, in some embodiments, the concentric tube arrangement 125 can be located away from the curved portion of the horizontal well, commonly referred to as the "heel" of the horizontal well. It should be understood that, in certain embodiments, the concentric tube arrangement 125 can tilt up or down towards the end of the well, commonly referred to as the "toe" of the horizontal well. However, it is preferable for the concentric tube arrangement 125 to be located in a portion of the well that has no angle up or down.

In certain embodiments a slight upward angle toward the toe is acceptable and is preferable to a downward angle toward the well toe. In some cases, the ultimate flatness of the horizontal section of the well is beyond control. However, the embodiments disclosed herein are intended to capitalize on a stratified flow regime. A stratified flow regime is characterized by liquid and gas flowing separately at the bottom and top of the horizontal pipe respectively. It is generally less ideal to have flow going uphill in the pipe. This creates a churn or slug flow. A slug or churn flow makes separation of the gas from the liquid more difficult. In the case of a downhill flow, the column or thickness of the liquid in the horizontal pipe decreases, which makes the processes of drawing the liquid into the dip tube more difficult.

A screened tube, such as screen 205 comprises a specially configured tubing section with orifices that allow liquid to enter the tube. In the embodiment illustrated in FIG. 2, the screen comprises longitudinally separated sections. Such screens serve to separate liquid from gas when a liquid and gas are flowing together, for example, in the horizontal section 160 of a horizontal well 120. In other embodiments screen 205 can be embodied as a perforated pipe.

Similarly, The inner tube 140 can generally be configured as a screen, a series of screened sections, or a standard dip tube with one or more screened sections. The defining characteristic of the inner tube 140 is that its outer diameter is smaller than the inner diameter of outer tube 135, such that the inner tube 140 can be installed, or otherwise configured, inside the outer tube 135.

Figure 3:
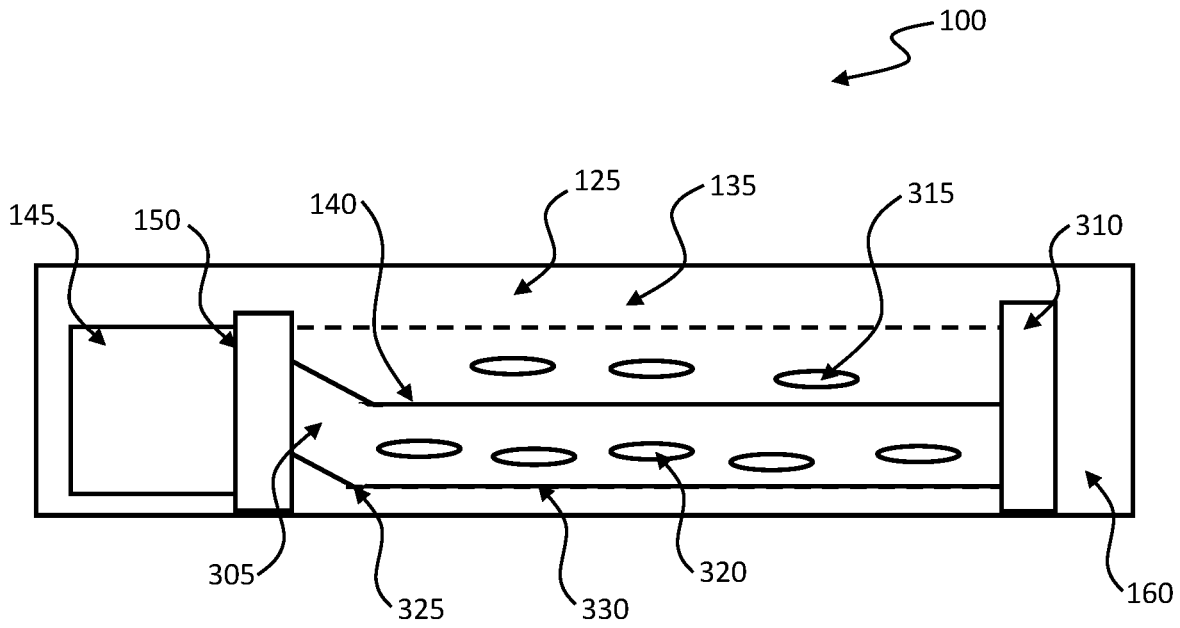
FIG. 3 depicts additional details of an extraction system in accordance with the disclosed embodiments.

FIG. 3 illustrates an embodiment of the system 100 in further detail. As shown in FIG. 3, the mainline 145 is preferably connected to the concentric tube arrangement 125 via fitting 150. The fitting 150 prevents liquid 315 that is within the outer tube 135, but not within the inner tube 140, from entering mainline 145. The fitting 150 allows liquid 320 that is within the inner tube 140 to enter the mainline 145.

In the embodiment illustrated in FIG. 3, the outer tube 135 is shown as a screened pipe, or perforated pipe, that therefore allows both liquid 315 and liquid 320 to enter the concentric tube arrangement. It should be understood that this is exemplary, and in other embodiments outer tube 135 can comprise standard pipe segments and screened pipe segments arranged in a multitude of ways according to design considerations.

However, inner tube 140 has a more specific configuration. Specifically inner tube 140 can be comprised of a first segment 305 that is standard, unscreened pipe or unperforated pipe. This first segment 305 is connected to mainline 145 via fitting 150. Liquid 320 flowing through inner tube 140 is thus allowed to enter mainline 145. The length of the first segment 305 is configured to be angled downward between the fitting 150 and the spot 325 where the bottom of inner tube 140 first contacts the inner bottom surface of outer tube 135. The remainder of the inner tube 140 can comprise one or more sections 330 of screened pipe that allows liquid 315 and/or liquid 320 to enter the inner tube 140. In certain embodiments, the distal end of the concentric tube arrangement 125 can be sealed with a bull plug 310.

The concentric tube arrangement 125, illustrated in FIG. 3, provides a way to prevent gases mixed with the liquids in the horizontal section 160 of well 120 from entering the mainline 145. The gas in the horizontal portion 160 of the well rises to the top of the wellbore and the liquid (e.g. oil, gas, water, etc.) comes in waves at the bottom. The outer tube's purpose is to block the waves and allow the liquid to flow consistently. However, it is inevitable that some gaseous content will still enter the outer tube 135. Therefore, the inner tube 140 is placed within the outer tube 135. The inner tube 140 lies against the bottom of the outer tube 135 so that only liquid within the inner "dip tube" is captured. The pump then delivers this liquid to the surface.

Figure 4:
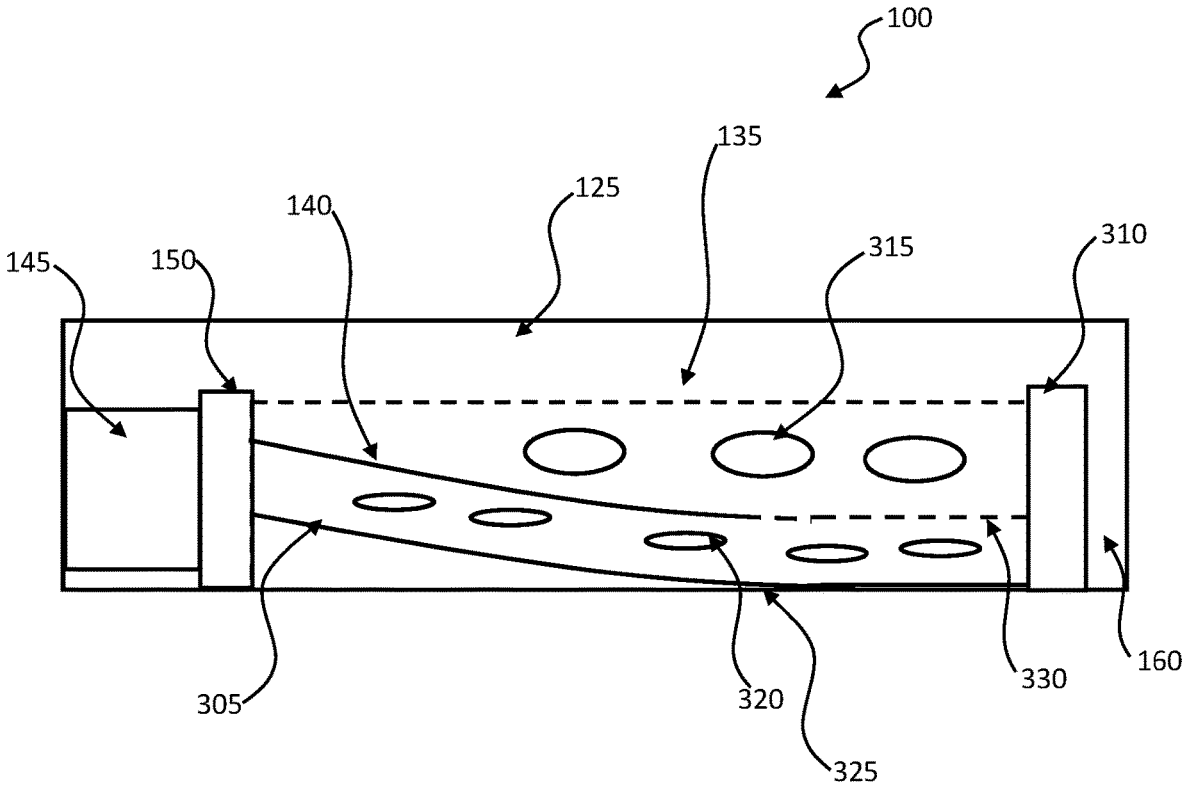
FIG. 4 depicts another embodiment of an extraction system in accordance with the disclosed embodiments.

FIG. 4 illustrates another embodiment of the system 100 in further detail. As in FIG. 3, the mainline 145 is preferably connected to the concentric tube arrangement 125 via fitting 150. The fitting 150 prevents liquid 315 that is within the outer tube 135, but not within the inner tube 140, from entering mainline 145. The fitting 150 allows liquid 320 that is within the inner tube 140 to enter the mainline 145.

In the embodiment illustrated in FIG. 4, the outer tube 135 is shown as a screened or perforated pipe, that therefore allows both liquid 315 and liquid 320 to enter the concentric tube arrangement. It should be understood that this is exemplary, and in other embodiments outer tube 135 can comprise standard pipe segments and screened or perforated pipe segments arranged in a multitude of ways according to design considerations.

In this embodiment the inner tube 140 can be comprised of a first segment 305 that is standard, unscreened pipe or unperforated pipe. This first segment 305 is connected to mainline 145 via fitting 150. Liquid 320 flowing through inner tube 135 is thus allowed to enter mainline 145. The length of the first segment 305 is between the fitting 150 and the spot 325 where the bottom of inner tube first contacts the inner bottom surface of outer tube 135 (due to gravitational deflection of the inner tube 135). The remainder of the inner tube can comprise one or more sections 330 of screened or perforated pipe that allows liquid 315 and/or liquid 320 to enter the inner tube 140. In certain embodiments, the distal end of the concentric tube arrangement 125 can be sealed with a bull plug 310.

Figure 5:
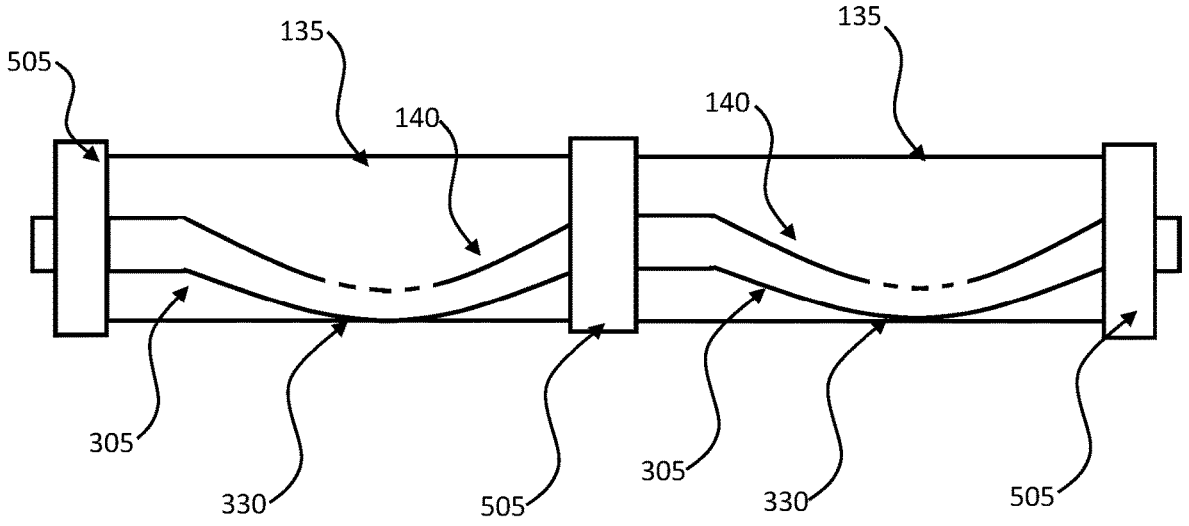
FIG. 5 depicts another embodiment of an extraction system in accordance with the disclosed embodiments.

It should be understood that, in certain embodiments, the inner tube 140 can comprise multiple sections, in order to extend further into the horizontal portion of the well bore. These sections can be connected with a cuff or sleeve 505. In such embodiments, the inner tube will be lifted away from the bottom of the outer tube at the connections. Thus, in such embodiments, the screened portion of inner tube 140 can be limited to those portions of the tube that are in contact with, or nearly in contact with, the bottom of the outer tube 135. This type of arrangement is illustrated in FIG. 5, with an exaggeration in the deflection for purposes of illustration.

Figure 6:
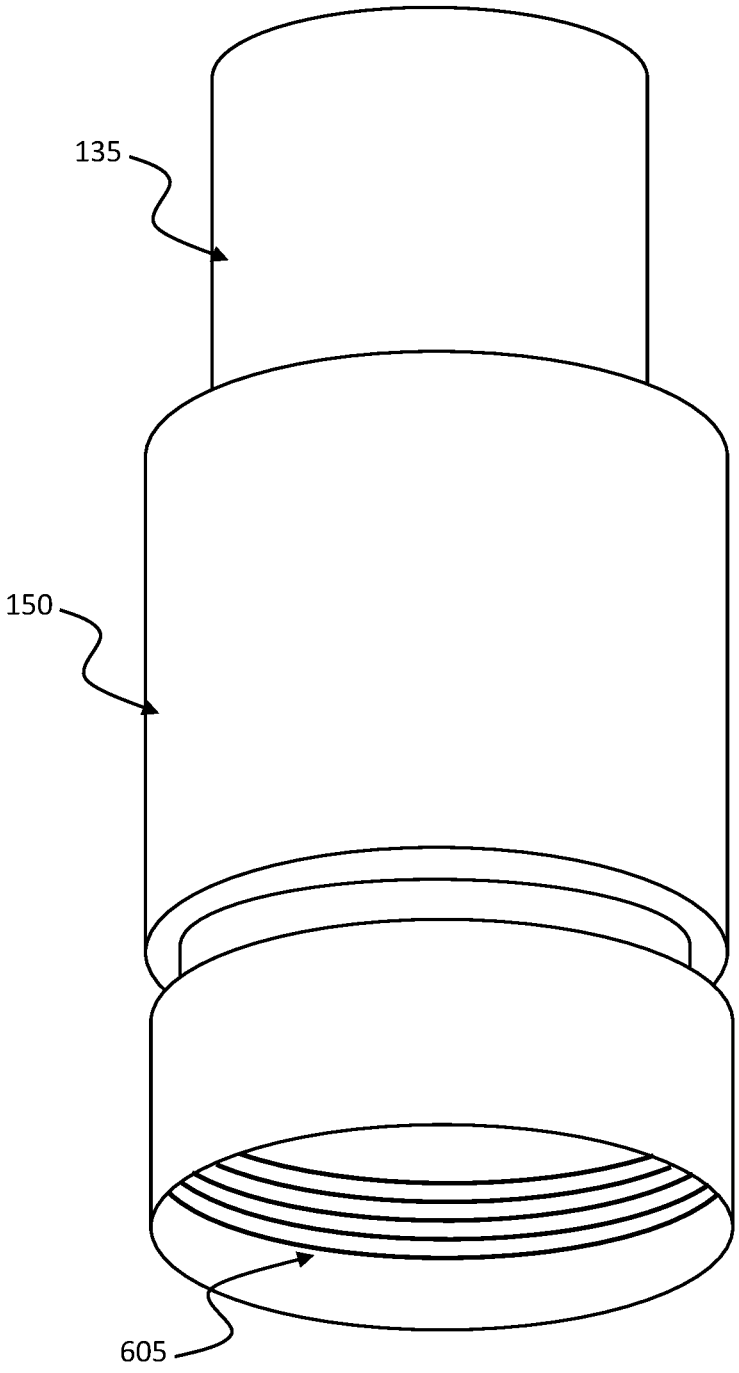
FIG. 6 depicts a fitting in accordance with the disclosed embodiments.

FIG. 6 illustrates fitting 150 in accordance with an embodiment. The fitting 150 can be complimented with an additional thread-type change over or crossover 605 that is configured to engage with threading on the mainline 145. The diameter of the outer tube 135 can essentially match that of the fitting 150. The fitting 150 is thus configured to connect to the outer tube 135 as illustrated in FIG. 6. Fitting 150 provides a conduit that further engages with inner tube 140 such that liquid inside inner tube 140 can flow through the conduit, but liquid external to the inner tube 140, and internal to the outer tube 135 is unable to flow into mainline 145.

Figure 7:
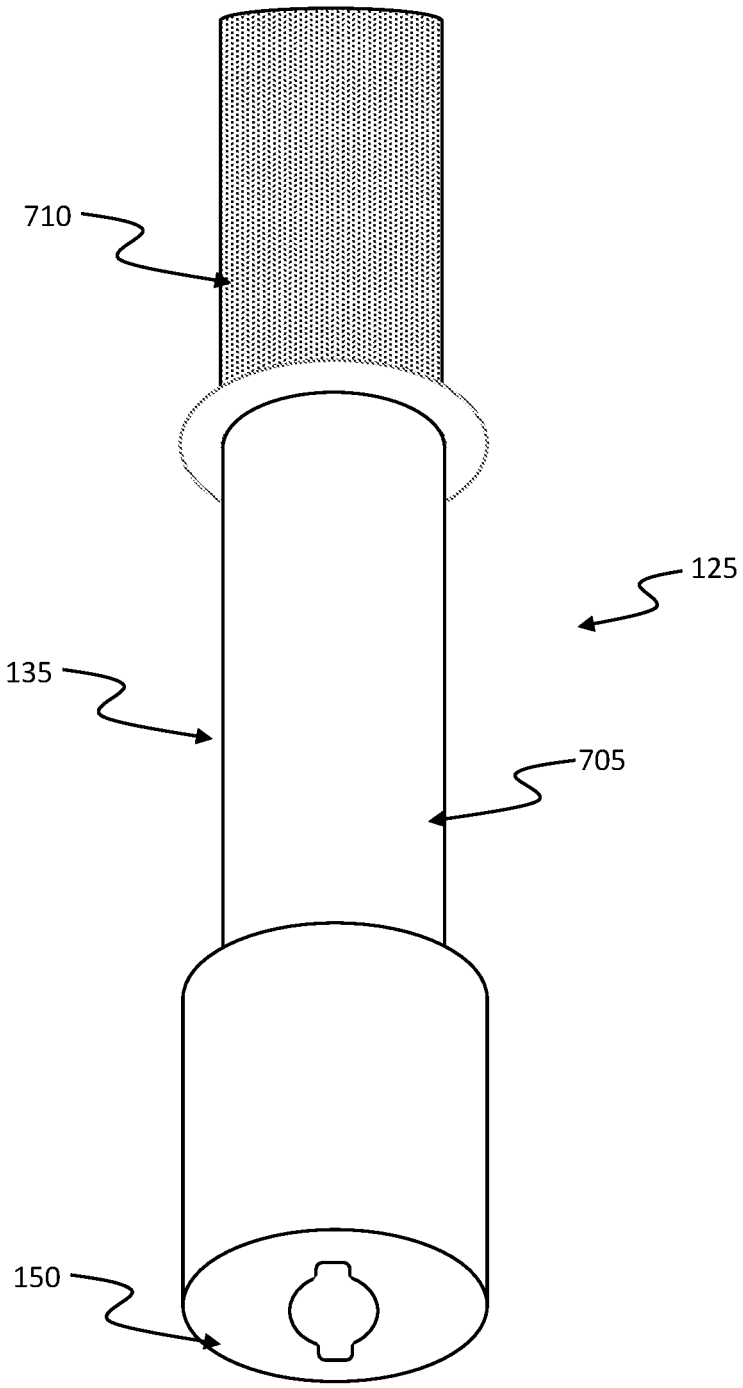
FIG. 7 depicts a concentric tube arrangement associated with an extraction system in accordance with the disclosed embodiments.

FIG. 7 illustrates an embodiment of the concentric tube arrangement 125. In this embodiment, the outer tube 135 comprises a short blank section 705 connected to a screened section 710. It should be understood that, in certain embodiments, one or more section of both the outer tube 135 and the inner tube 140 can comprise blank tube sections and/or screened or perforated tube sections. The inner tube 140 is not visible in this illustration, but is disposed inside outer tube 140.

It should be understood that, as shown in FIG. 7, the only place where the inner tube is not laying along the bottom of the dip tube is at the joints. At these joints, the inner tube will be centered within the outer tube so that different sections of tube can be screwed together. In an embodiment, the optimal length for this apparatus is approximately 48 feet, with only two joints within that length. In general, the greater a well's production rate, the longer the system should be, and the more joints are required. Thus, in other embodiments, other lengths may alternatively be used.

Figure 8:
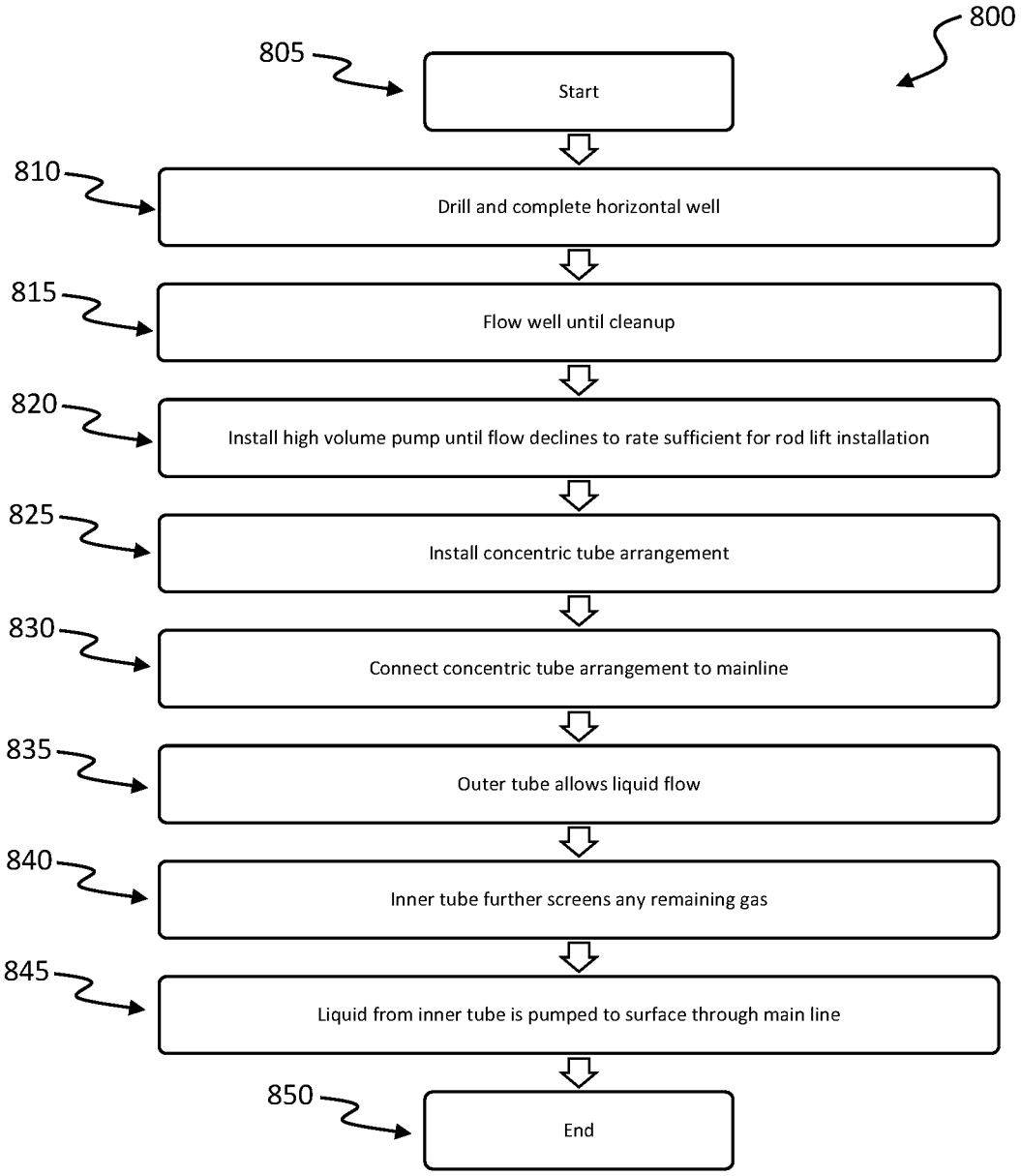
FIG. 8 depicts a flow chart illustrating steps associated with an extraction method in accordance with the disclosed embodiments.

FIG. 8 illustrates a flow chart 800 of steps associated with a method for separating gas from liquid collected in the horizontal section of a well. The method begins at 805. Upon the drilling and completion of a well with a horizontal section at 810, the well can be flowed until cleanup, as shown at 815. A high volume pump can optionally be used until flow declines as shown at 820.

Next, the concentric tube arrangement can be disposed in the horizontal portion of the well at 825. With the concentric tube arrangement in place, the mainline pipe can be connected to the concentric tube arrangement at 830. The outer tube allows liquid flowing in the wellbore to enter the outer tube while substantially preventing gas from entering the outer tube at 835. Any gas that enters the outer tube is further screened by the inner tube, thereby essentially eliminating any gaseous flow in the inner tube at 840. The purely liquid flow in the inner tube can then be pumped out of the concentric tube arrangement, through the mainline, for production at the surface of the well at 845. The method ends at 850.

Overall, the use of the disclosed dual flow system can increase the efficiency of a production well. The well will be able to effectively pump just liquid (e.g. oil, water, etc.), which will reduce mechanical failures that occur when gaseous content is introduced to the pump. In turn, this will lower the intake pressure at the perforations, or producing formations, resulting in a lower measured $P_{WF}$ and increased rate. Ultimately, the disclosed technology should drastically reduce, or eliminate, the need for packers in a horizontal production well and improve production efficiency.

Based on the foregoing, it can be appreciated that a number of embodiments, preferred and alternative, are disclosed herein. For example, in an embodiment, a system for separating liquid from gas in a horizontal well comprises a first tubing member comprising one of a screen-walled tube and a perforated tube, and a second tubing member configured inside the first tubing member, the second tubing member comprising a blank-walled tube section and one of a screen walled tube section and a perforated tube section, wherein the second tubing member has a smaller diameter than the first tubing member.

In an embodiment, the second tubing member is in fluidic connection with a mainline pipe. In an embodiment the fluidic connection between the second tubing member and the mainline pipe is located in a non-vertical portion of the horizontal well.

In an embodiment, the blank walled tubing member extends from the connection between the second tubing member and the main pipe, to a point where the second tubing member contacts the first tubing member, and wherein the screen walled section of the second tubing member extends from the point where the second tubing member contacts the first tubing member to a terminal end of the second tubing member. In an embodiment the point where the second tubing member contacts the first tubing member further comprises a point substantially on a lower half diameter of the first tubing member.

In an embodiment the system further comprises a pump attached to the main pipe configured to pump the liquid to a surface of the horizontal well. In an embodiment, the pump comprises a rod pump.

In another embodiment, an apparatus for extracting liquid from a well comprises a first tubing member comprising at least one of a screen-walled tube and a perforated tube, a second tubing member configured inside the first tubing member, the second tubing member comprising a blank-walled tube section and one of a screen walled tube section and a perforated tube section, wherein the second tubing member has a smaller diameter than the first tubing member, a mainline pipe connected to the second tubing member, and a pump for extracting liquid in the second tubing member.

In an embodiment the apparatus further comprises a connection member creating a fluidic connection between the second tubing member and the mainline pipe. In an embodiment, the fluidic connection between the second tubing member and the main pipe is located in a non-vertical portion of the horizontal well.

In an embodiment, the blank walled tubing member extends from the connection between the second tubing member and the mainline pipe, to a point where the second tubing member contacts the first tubing member, and wherein the screen walled section of the second tubing member extend from the point where the second tubing member contacts the first tubing member to a terminal end of the second tubing member. In an embodiment, the point where the second tubing member contacts the first tubing member further comprises a point substantially on a lower half diameter of the first tubing member.

In an embodiment the non-vertical portion of the horizontal well further comprises a substantially flat horizontal portion of the well. In an embodiment, the pump comprises a rod pump.

In yet another embodiment, a method for extracting liquid from a well comprises: collecting flowing liquid in a first tubing member comprising at least one of a screen-walled tube and a perforated tube, moving liquid in the first tubing member into a second tubing member configured inside the first tubing member, the second tubing member comprising a blank-walled tube section and at least one of a screen walled tube section and a perforated tube section, wherein the second tubing member has a smaller diameter than the first tubing member, pulling liquid in the second tubing member into a mainline pipe connected to the second tubing member with a connection member, and pumping the liquid in the mainline pipe to a well surface.

In an embodiment, the method further comprises inserting the first tubing member and the second tubing member in a non-vertical portion of the horizontal well.

In an embodiment the method further comprises extending the blank walled tubing member from the connection between the second tubing member and the mainline pipe, to a point where the second tubing member contacts the first tubing member, and extending the screen walled section of the second tubing member from the point where the second tubing member contacts the first tubing member to a terminal end of the second tubing member.

In an embodiment the point where the second tubing member contacts the first tubing member further comprises a point substantially on a lower half diameter of the first tubing member.

In an embodiment the non-vertical portion of the horizontal well further comprises a substantially flat horizontal portion of the well. In an embodiment the pump comprises a rod pump.

It will be appreciated that variations of the above-disclosed and other features and functions, or alternatives thereof, may be desirably combined into many other different systems or applications. Also, it should be appreciated that various presently unforeseen or unanticipated alternatives, modifications, variations or improvements therein may be subsequently made by those skilled in the art which are also intended to be encompassed by the following claims.

What is claimed is:

1. A system for separating liquid from gas in a horizontal well comprising:

a first tubing member comprising one of a screen-walled tube or a perforated tube; and a second tubing member configured inside said first tubing member, said second tubing member comprising a blank-walled tube section and one of a screen walled tube section or a perforated tube section wherein said blank-walled tube section extends from a connection between said second tubing member and a mainline pipe, to a point where said second tubing member contacts said first tubing member, and wherein said screen walled tube section of said second tubing member extends from said point where said second tubing member contacts said first tubing member to a terminal end of said second tubing member, wherein said second tubing member has a smaller diameter than said first tubing member.

2. The system of claim 1 wherein said second tubing member is in fluidic connection with said mainline pipe.

3. The system of claim 2 wherein said fluidic connection between said second tubing member and said mainline pipe is located in a non-vertical portion of said horizontal well.

4. They system of claim 1 wherein said point where said second tubing member contacts said first tubing member further comprises a point on a lower half diameter of said first tubing member.

5. The system of claim 1 further comprising:

a pump attached to said mainline pipe configured to pump said liquid to a surface of said horizontal well.

6. The system of claim 5 wherein said pump comprises a rod pump.

7. An apparatus for extracting liquid from a horizontal well comprising:

a first tubing member comprising at least one of a screen-walled tube or a perforated tube;

a second tubing member configured inside said first tubing member, said second tubing member comprising a blank-walled tube section and one of a screen walled tube section or a perforated tube section, wherein said second tubing member has a smaller diameter than said first tubing member;

a mainline pipe connected to said second tubing member;

wherein said blank-walled tube section extends from a connection between said second tubing member and said mainline pipe, to a point where said second tubing member contacts said first tubing member, and wherein said screen walled tube section of said second tubing member extends from said point where said second tubing member contacts said first tubing member to a terminal end of said second tubing member; and a pump for extracting liquid in said second tubing member.

8. The apparatus of claim 7 further comprising a connection member creating a fluidic connection between said second tubing member and said mainline pipe.

9. The apparatus of claim 8 wherein said fluidic connection between said second tubing member and said mainline pipe is located in a non-vertical portion of said well.

10. The apparatus of claim 9 wherein said non-vertical portion of said well further comprises a substantially flat horizontal portion of said well.

11. They apparatus of claim 7 wherein said point where said second tubing member contacts said first tubing member further comprises a point on a lower half diameter of said first tubing member.

12. The apparatus of claim 7 wherein said pump comprises a rod pump.

13. A method for extracting liquid from a well comprising:

collecting flowing liquid in a first tubing member comprising at least one of a screen-walled tube or a perforated tube;

moving liquid in said first tubing member into a second tubing member configured inside said first tubing member, said second tubing member comprising a blank-walled tube section, said blank-walled tube section extending from a connection between said second tubing member and a mainline pipe, to a point where said second tubing member contacts said first tubing member, and at least one of a screen walled tube section or a perforated tube section said screen walled tube section or said perforated tube section of said second tubing member extending from said point where said second tubing member contacts said first tubing member to a terminal end of said second tubing member, wherein said second tubing member has a smaller diameter than said first tubing member;

pulling liquid in said second tubing member into said mainline pipe connected to said second tubing member with a connection member; and pumping said liquid in said mainline pipe to a well surface.

14. The method of claim 13 further comprising:

inserting said first tubing member and said second tubing member in a non-vertical portion of said well.

15. The method of claim 14 wherein said non-vertical portion of said well further comprises a substantially flat horizontal portion of said well.

16. They method of claim 13 wherein said point where said second tubing member contacts said first tubing member further comprises a point on a lower half diameter of said first tubing member.

17. The method of claim 13 wherein a pump is used for pumping said liquid in said mainline pipe to said well surface, said pump comprising a rod pump.

* * * * *